United States Patent [19]

Sverdlin

[11] Patent Number: 4,869,212

[45] Date of Patent: Sep. 26, 1989

[54] MODULAR UNIVERSAL COMBUSION ENGINE

[75] Inventor: Anatoly Sverdlin, Seabrook, Tex.

[73] Assignee: Automated Marine Propulsions Systems, Inc., La Porte, Tex.

[21] Appl. No.: 100,182

[22] Filed: Sep. 23, 1987

[51] Int. Cl.[4] ..... F02B 75/24

[52] U.S. Cl. ..... 123/56 BC; 123/58 R

[58] Field of Search ..... 123/DIG. 6, 58 R, 58 C, 123/59 R, 56 AC, 56 BC, 56 R, 58 AM, 58 B, 58 BC, 59 B

[56] References Cited

U.S. PATENT DOCUMENTS

| | | | |
|---|---|---|---|
| 780,549 | 1/1905 | Callan . | |
| 960,063 | 5/1910 | Beckmann . | |
| 1,168,877 | 1/1916 | Froehlich . | |
| 1,355,485 | 10/1920 | Baradat | 123/58 B |
| 1,479,918 | 1/1924 | Lleo et al. | 123/58 BC |
| 1,543,113 | 6/1925 | Lleo et al. | 123/58 BC |
| 1,656,884 | 1/1928 | Davol | 123/DIG. 6 |
| 1,702,467 | 2/1929 | Davol | 123/DIG. 6 |
| 1,716,020 | 6/1929 | Winckler . | |
| 2,635,484 | 4/1953 | Karow . | |
| 2,957,462 | 10/1960 | Clark | 123/58 BC |
| 3,196,698 | 7/1965 | Liddington . | |
| 3,198,022 | 8/1965 | De Waern . | |
| 3,498,053 | 3/1970 | Johnston | 123/65 BA |
| 3,528,394 | 9/1970 | Cummins . | |
| 4,169,436 | 10/1979 | Welch et al. . | |
| 4,235,116 | 11/1980 | Meijer et al. . | |

OTHER PUBLICATIONS

C. P. Propellers—A. S. Wichmann Brochure.

"Kinematic Structure of Mechanisms for Fixed and Variable-Stroke Axial-Piston Reciprocating Machines", Journal of Mechanisms, Transmissions, and Automation in Design, Sept. 1984, vol. 106, pp. 305-364 (Freudenstein and Maki).

"Kinematic Structural and Functional Analysis of Wobble-Plate Engines", Journal of Mechanisms, Transmissions, and Automation in Design, June 1986, vol. 108, pp. 227-236 (Zu and Lee).

*Primary Examiner*—David A. Okonsky

*Attorney, Agent, or Firm*—Dodge, Bush & Moseley

[57] ABSTRACT

An engine for rotating a main drive shaft (14) from a plurality of power modules (18) arranged in a concentric circumferentially spaced relation about a main drive gear (12) secured to the main drive shaft (14). Each power module (18) has a pair of parallel cylinders (50) with associated pistons (52) therein connected to rocker arms (62) and Z-crank convertors (68) for rotating a power input gear (20) engaging the main gear (12) for rotating the main drive shaft (14).

33 Claims, 6 Drawing Sheets

10
12
14
16
17
18
20
24
26
28
32
34
38
48
50
52
53
58

MODULAR UNIVERSAL COMBUSION ENGINE

BACKGROUND OF THE INVENTION

This invention relates to engines for rotating a drive shaft and more particularly to such an engine in which the cylinders and axial movement of the associated reciprocating pistons are parallel to the longitudinal axis of the drive shaft.

Heretofore, so-called wobble plate and swash plate mechanisms for reciprocating piston engines have been provided in which the cylinders of such engines have been arranged in a parallel relation to a drive shaft. In such engines, the translatory reciprocating movement of the pistons within the cylinders has been converted to a rotational movement for rotating an axle or drive shaft by the utilization of an inclined rotating disc connected to a shaft with the inclined rotating disc engaged eccentrically from linkages driven from the longitudinal axial movement of the pistons thereby to rotate the disc and associated shaft which is operatively connected to the drive shaft for rotation thereof.

However, such wobble plate mechanisms for reciprocating piston engines have been connected directly to the connecting rods for the pistons and have been axially aligned with the longitudinal axis of the main drive shaft for converting the reciprocating movement of the pistons to the rotational movement of the drive shaft in drive relation thereto. Such a positioning and arrangement of the wobble plate mechanism has a number of disadvantages. First, it is difficult, particularly in an opposed piston, two cycle engine to open exhaust ports before the opening of intake ports, and to close the exhaust ports before the closing of the intake ports, which is necessary in order to clean the cylinder of residual exhaust gases. When a large number of pistons in a multiple cylinder engine are connected to a single wobble plate, it is practically impossible to control the firing order of the engine with a minimum of engine vibration and associated noise. When all pistons are connected to a single wobble plate, it is likewise very difficult to control the firing sequence angle as such angles are controlled by the movement of the common wobble plate. An engine having such a wobble plate construction is illustrated in U.S. Pat. No. 4,169,436, dated Oct. 2, 1979 and shows a plurality of cylinders mounted in circumferentially spaced relation about the longitudinal axis of a drive shaft and having opposed pistons therein connected to a wobble plate adjacent each end of the cylinders for rotating the drive shaft.

Another example is shown in U.S. Pat. No. 3,196,698, dated July 27, 1965 in which an internal combustion engine has a crankshaft and a plurality of cylinders mounted in circumferentially spaced relation about the crankshaft with pairs of opposed pistons mounted in such cylinders. A pair of wobble plate linkages are positioned adjacent each of the ends of the cylinders thereby providing four (4) wobble plate arrangements with each wobble plate arrangement being driven by three (3) pistons through associated connecting rods.

In a wobble plate mechanism, the wobble plate oscillates between two inclined positions and also rotates simultaneously about two intersecting axes. The wobble plate mechanism normally has three (3) degrees of freedom as an independent rotational degree of freedom is provided about the longitudinal axis of a link between two joints, one joint being at the connection of a linkage to the piston and the other joint being a connection of the linkage adjacent the wobble plate. Ball joints may be utilized as a joint for a linkage at the piston and for the joint for the connection of the linkage to the wobble plate.

A related motion which is similar to that of the so-called wobble plate motion is obtained by a so-called Z-crank convertor. A Z-crank convertor is obtained by a pair of spaced opposed base members or blocks axially aligned with each other. Each base member or block has an inclined thrust bearing face with the inclined bearing faces being in an opposed spaced relation to each other.

Heretofore, it has been complicated, time consuming, and expensive to replace defective or worn pistons, cylinders, and connecting linkages for drive shafts or the like in reciprocating piston type engines or machines. Normally, a single-block type engine body is used and it has been necessary in order to obtain access to the pistons to remove covers or heads from the engine block which exposes all of the cylinders and pistons in order to remove or repair a single piston or cylinder.

Additionally, previous Z-crank convertor mechanisms provided between reciprocating pistons and a rotating drive shaft, have utilized a relatively large number of freedoms of movement in the linkage such as, for example, a pair of ball joints between the piston and the associated Z-crank mechanism. It is difficult to provide suitable lubrication for ball joints and to minimize any excessive leakage of the lubrication from such ball joints.

SUMMARY OF THE INVENTION

The present invention is directed generally to an engine having pistons mounted for reciprocation within cylinders arranged in a circumferentially spaced relation about the longitudinal axis of a drive shaft. The engine may be of the internal combustion type or external combustion type. The pistons are preferably mounted in individual power units or modules, each power module having a pair of spaced parallel cylinders with each cylinder having a pair of opposed pistons mounted therein for reciprocal movement in opposite directions.

Improved convertors extend between the pistons and the drive shaft for converting the reciprocating axial movement of the pistons to a rotational movement for rotating the drive shaft. The internal combustion mode of the modular universal combustion engine is preferably a two-cycle uniflow scavenging system. To achieve greater efficiency from two-stroke uniflow scavenging systems an asymmetrical scavenging system must be utilized, which means that the piston which controls the exhaust ports leads the piston which controls the intake ports. In other words, the exhaust ports should open before the intake ports open, and close before the intake ports close, which makes it possible to better clean the associated cylinder of residual exhaust gases. It is possible to achieve this demand because both pistons are in a single cylinder and are not connected to a common wobble plate through any other mechanism. The piston which controls exhaust ports is connected to its own rocker arm which drives its own Z-crank convertor and through an independent power input gear meshes with a second central power output gear. Both pistons, (exhaust and intake), could be connected in the following ways: exhaust and intake connected to symmetrical rocker arms, exhaust and intake connected to asymmetrical rocker arms, exhaust connected to symmetrical rocker arm and intake to asymmetrical rocker arm or symmetrical rocker arm depending upon the engine application requirements. Thus, both pistons transmit work to the central gear through their own independent power input gears. This makes it possible to connect the exhaust piston reciprocally to the piston which controls the intake port and match any possible efficient leading angle, also depending on engine application requirements.

Each of the separate individual power modules or units drives a Z-crank power input shaft having a pinion gear mounted on the end thereof which is in driving engagement and meshes with the outer periphery of a main drive gear having a main drive shaft secured thereto about its longitudinal axis. Thus, the power modules are arranged in a circumferentially spaced relation about the outer periphery of the main drive gear and each of the power units is arranged within a predetermined equal segment of the main drive gear. Each of the power modules has a rocker arm connected to connecting rods for the pistons adjacent each end of the cylinders and each rocker arm drives its Z-crank convertor unit assembly. Thus, the rocker arm by being connected to only two pistons may be turned or positioned at any desired angle for minimizing any torsional oscillation while providing a balanced engine to achieve increased thermal and mechanical efficiencies. It is apparent that the pistons in the present invention remain fixed at the rocker arm which is connected at its center to the Z-crank convertor for all speeds. The sum of the forces due to the acceleration of the pair of pistons is zero. When one pair of opposed pistons accelerates outwardly the other pair of opposed pistons are receiving an equal acceleration inwardly thereby to balance all inertia forces. There are no piston inertia forces acting on the shaft since the movement of the pistons is parallel to the longitudinal axis of the shaft.

The present invention further permits each rocker arm which is connected only to two pistons to be positioned relative to adjacent power modules at any desired phase angle thereby to eliminate any torsional oscillation for achieving an efficient firing order. This is possible because, in the present invention, the pistons are not coupled to the common mechanism but are separated into individual power units which transfer work to the central power collecting shaft through an plurality of power input gears circumferentially spaced about a central output gear. Such an arrangement has the advantages of perfectly balancing the engine to achieve better thermal and mechanical efficiency and permitting less weight per horsepower to provide an engine very quiet in operation. Also, the separate connection from each power input unit coupled to the central gear on the drive shaft makes it possible to utilize not only an internal combustion cycle but also an external combustion cycle such as a Stirling engine, for example.

The improved Z-crank convertor of the present invention between the pistons and drive shaft for each of the separate power modules includes a connecting rod pivotally connected at one end to each piston and pivotally connected at its opposite end about a universal joint to the end of a rocker arm positioned adjacent each end of the spaced cylinders. The universal joint permits the rocker arm to oscillate about its longitudinal axis during the stroke of the associated piston. The ends of the rocker arms move back and forth in an arcuate path extending in a three dimensional plane while oscillating about their longitudinal axes.

The so-called Z-crank convertor mechanism is connected to each rocker arm for converting the reciprocating motion of the pistons to the rotating movement of the output drive shaft. The longitudinal axes of the drive shaft and pistons are parallel. One of the opposed Z-crank convertor is driven and converts the power strokes of two (2) associated pistons while the other opposed Z-crank convertor is a follower without transmitting power but maintaining the bearing block in a continuous drive relation to the driven Z-crank convertor during the entire rotational cycle. The input shaft on the driven Z-crank convertor is operatively connected to the power output or drive shaft for rotating the power output shaft.

The utilization of a linkage between the pistons and the drive shaft including a Z-crank convertor mechanism provides a balanced system which provides a lower vibration and mechanical noise level as well as increasing the service life of the associated pistons and cylinders. Moreover, a highly compact engine body is obtained by the utilization of modules permitting utilization of such an engine where space is limited, such as underwater and aerospace applications, for example.

It is an object of the present invention to provide a reciprocating piston type engine in which the longitudinal axes of the main drive shaft and the associated cylinders are parallel.

It is an additional object of this invention to provide such an engine in which a plurality of individual power modules are arranged in a circumferentially spaced relation about the outer periphery of a main drive gear with each power module having a power input shaft and associated gear for engaging the periphery of the main drive gear in driving relation.

A further object of this invention is to provide such an engine which achieves increased thermal and mechanical efficiency and has a relatively low weight per horsepower ratio while providing long stroke to bore ratios.

An additional object is to provide a reciprocating piston-type combustion engine which is suitable for use with internal or external combustion cycles and which has a balanced engine for minimizing vibrations and noises.

It is a further object of the invention to provide such a reciprocating piston type engine in which a plurality of individual power modules are arranged in a circumferential spaced relation about the longitudinal axis of a drive shaft with each module including cooperating pistons and cylinders and being separately removable from the engine for repair and/or replacement.

Another object of the invention is to provide such an engine in which an improved Z-crank convertor mechanism is provided between the pistons of the power module and the main drive shaft for converting the reciprocating motion of the pistons to a rotary movement of the drive shaft.

Another object is to provide such a separate power module which includes a Z-crank convertor mechanism having a rocker arm connected at its ends to a pair of spaced pistons for moving the rocker arm back and forth in a three dimensional plane while permitting the rocker arm to oscillate about its longitudinal axis thereby to impart movement to the associated Z-crank convertor.

An additional object is to provide such an improved engine for utilization with a hollow drive shaft having a propeller thereon and means within the hollow drive shaft for controlling the pitch and thrust direction of the propeller.

Another object is to provide a gas turbocharger in combination with a internal combustion engine which utilizes exhaust gases from the engine and conveys the compressed air to the engine thereby resulting in an increased power output from the engine.

Other options, features, advantages of this invention will become more apparent after referring to the following specifications and drawings.

DESCRIPTION OF THE INVENTION

Figures 1, 2, 3:
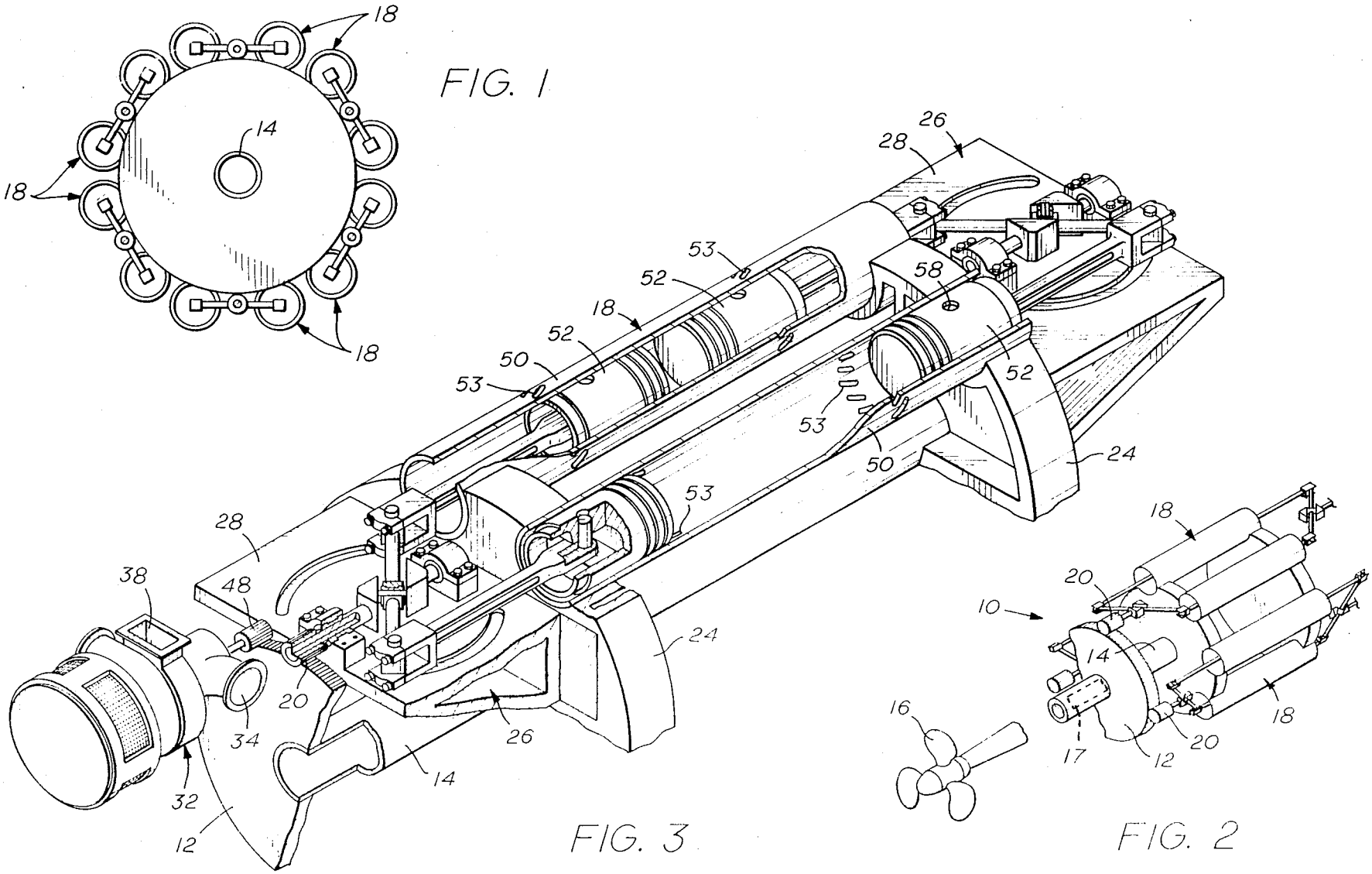
FIG. 1 is a schematic view showing a plurality of separate power modules or units arranged in a circumferentially spaced relation about the longitudinal axis of a main drive gear secured to a drive shaft.
FIG. 2 is a schematic view illustrating a power take-off from the drive shaft of the engine connected to a propeller, such as might be utilized for marine type engines.
FIG. 3 is a perspective view, certain parts broken away and shown in section, illustrating a power module for the engine and a gas turbocharger in combination with the engine for increasing the power output for the engine.

Referring now to FIGS. 1–5 of the drawings for a better understanding of this invention, and more particularly to FIGS. 1 and 2 in which a modular universal combustion engine is shown schematically at 10 for rotating a relatively large diameter main drive gear shown at 12 secured to a hollow power output or main drive shaft 14 which is shown as connected to a propeller 16 on a marine vehicle, for example. Hollow drive shaft 14 may be of a relatively large diameter sufficient to receive a control device 17 therein for controlling the desired pitch or direction of rotation of propeller 16. Such a control means mounted within a hollow shaft for controlling the pitch of a propeller is well known for marine systems and may be obtained from AS Wichmann, N-5420 Rubbestadneset, Norway, designated as a Wichmann controllable pitch system.

For rotation of drive shaft 14 a plurality of generally identical power modules or drive units are shown generally at 18 and are arranged in a concentric circumferentially spaced relation about main drive gear 12. Six (6) separate power modules 18 are illustrated in FIG. 2 and each unit 18 is positioned within a segment of sixty (60) degrees of the circular path about gear 12 and drive shaft 14. Each power module 18 is arranged for rotating a power input gear 20 adjacent each end of power module 18 which meshes with associated main gear 12 for rotating shaft 14. As will be explained in further detail below, the power module 18 may be individually removed from engine 10 for repair and replacement as desired.

Figure 4:
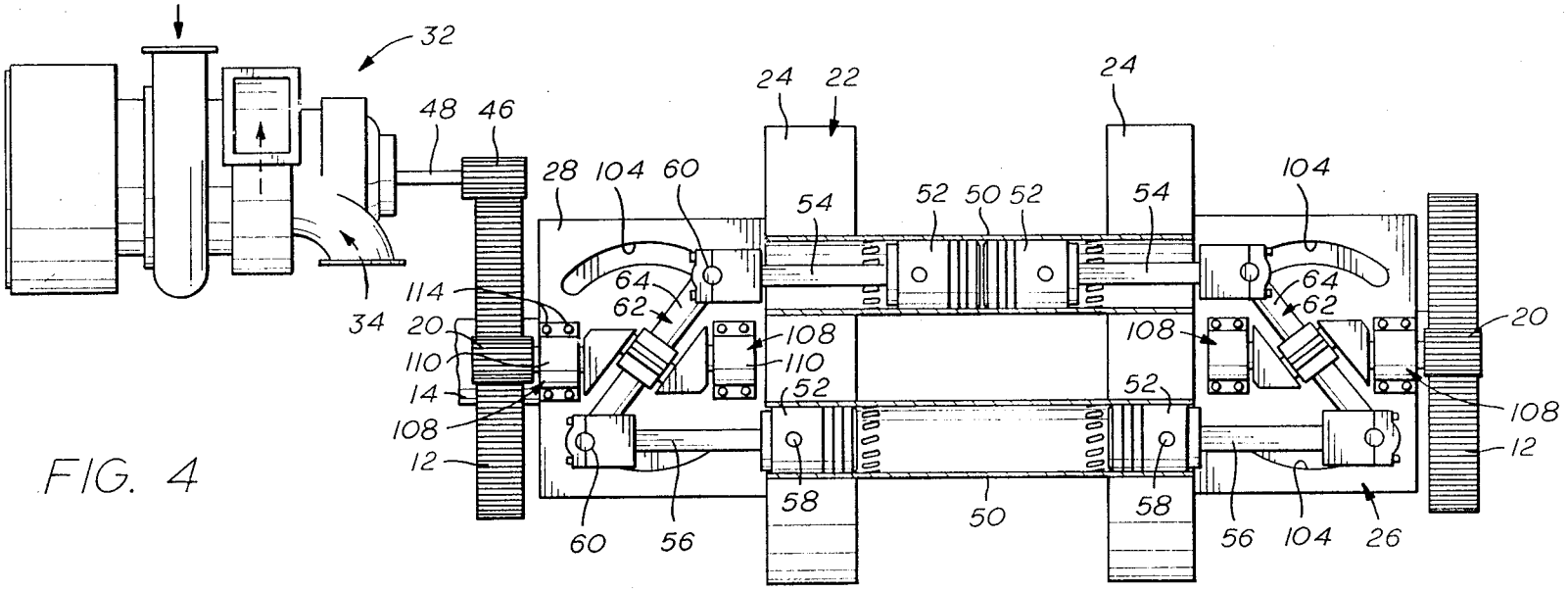
FIG. 4 is a top plan view, certain parts broken away and shown in section, of a power module showing a Z-crank convertor mechanism and cooperating gears for rotating the drive shaft.
Figure 10:
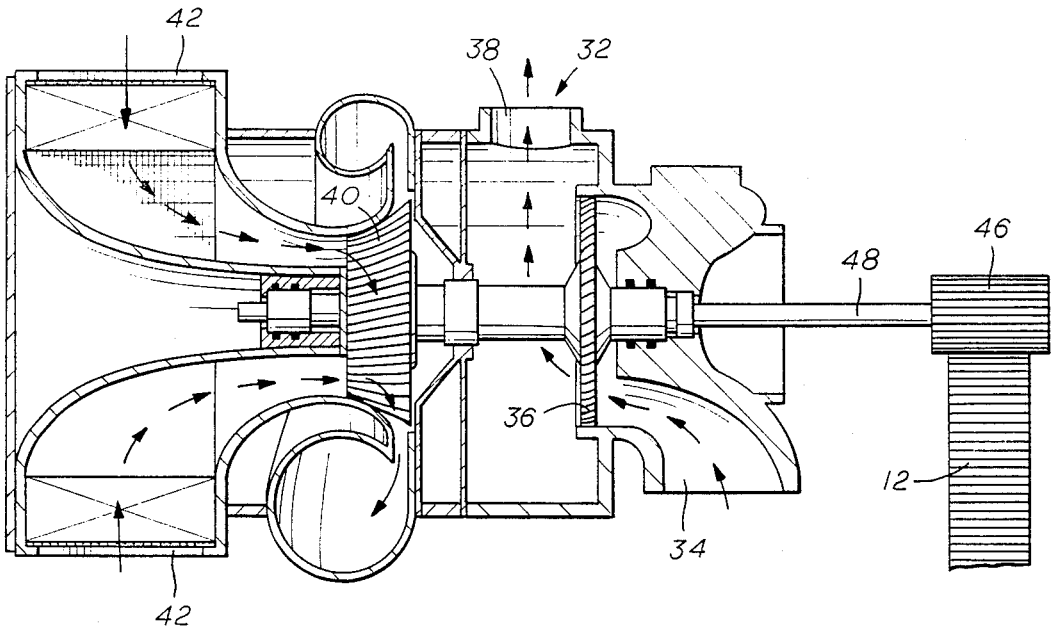
FIG. 10 is an enlarged top plan similar to FIG. 6 but showing the rocker arm at a location intermediate the stroke of the associated piston.

As shown particularly in FIGS. 3–4, an engine base support is illustrated generally at 22 and includes a pair of spaced end heads 24 having associated end support plates 26 secured thereto and defining a relatively smooth upper supporting surface 28 for each power module 18. Base support 22 has bearings 30 thereon supporting drive shaft 14 for rotation. A turbocharger is shown generally at 32 in FIG. 10 and exhaust gas from engine 10 flows through an inlet 34 for rotating a turbine rotor 36 and is then discharged through outlet 38. A compressor 40 draws air from suction inlets 42 for compression by compressor 40 and then discharges the compressed air through a pressurized outlet 44 for being fed to engine 10 thereby resulting in an increased power output as is well known. At low speeds, a pinion 46 and connected shaft 48 are driven by drive gear 12.

Referring now particularly to FIGS. 3 and 4, a single power module or unit 18 is illustrated, it being understood that the remaining power modules 18 are identical to that shown in FIGS. 3 and 4. Power module 18 includes a pair of spaced cylinders 50 which extend between and are removably mounted in pockets 51 on end heads 24. Mounted in each cylinder 50 are a pair of opposed pistons 52. Connecting rods 54 and 56 have one end pivotally connected by pins 58 to pistons 52 and have an opposite end pivotally connected at 60 to a rocker arm generally indicated at 62 and including rocker arm portions 64 and 66.

A Z-crank convertor is indicated generally at 68 and is connected between rocker arm 62 and pinion gear 20 to provide driving rotation of a power input shaft 70 secured to pinion 20 which is in driving relation to the outer periphery of main gear 12 for rotating power output drive shaft 14. Z-crank convertor or convertor mechanism 68 includes a bearing block indicated generally at 72 and positioned centrally of the length of rocker arm 62. Bearing block 72 includes a pair of split body portions 74 having split bearing sleeves 76 therein for fitting around a main bearing pin 78. Body portions 74 are secured about split sleeves 76 by a plurality of threaded bolts 80. Z-crank pin 78 has opposed parallel planar thrust bearing surfaces or faces 82 and 84 which extend outwardly beyond adjacent body portions 74 and split sleeves 76.

Rocker arm portions 64 and 66 are secured to body portions 74 adjacent one end thereof and the other end thereof fits within bearing cap 86. Bearing cap 86 has its ends 88 pivotally mounted within suitable openings 90 of a clevis 92 secured to connecting rod 54. Pivoted ends 88 of cap 86 form the pivot generally indicated at 60. Removable end pieces 93 of clevis 92 permit removal of caps 86. Removal of screw 95 and associated thrust plate or washer 97 permits bearing caps 86 to be removed from rocker arm portions 64, 66. Rocker arm portion 66 is mounted in a similar manner to connecting rod 56 and corresponding numerals indicate corresponding parts for rocker arm portion 66. It is noted that rocker arm portions 64 and 66 may rotate freely within caps 86.

A pair of Z-crank convertor webs or members indicated at 94 and 96 have opposed planar thrust faces 98 and 100 which are in bearing contact with respective faces 82 and 84 of bearing pin 78. Surfaces or faces 98 and 100 are planar parallel thrust surfaces. A follower shaft 102 mounted for free rotation is secured to convertor member 94 and power input shaft 70 is secured to convertor member 96. Z-crank convertor 68 maintains bearing pin 78 in bearing contact with thrust face 100 of Z-crank convertor member 96 at an eccentric location with respect to the longitudinal axis of power input shaft 70 thereby to act as an offset crank for rotation of power input shaft 70 and pinion gear 20 connected thereto.

Figure 5:
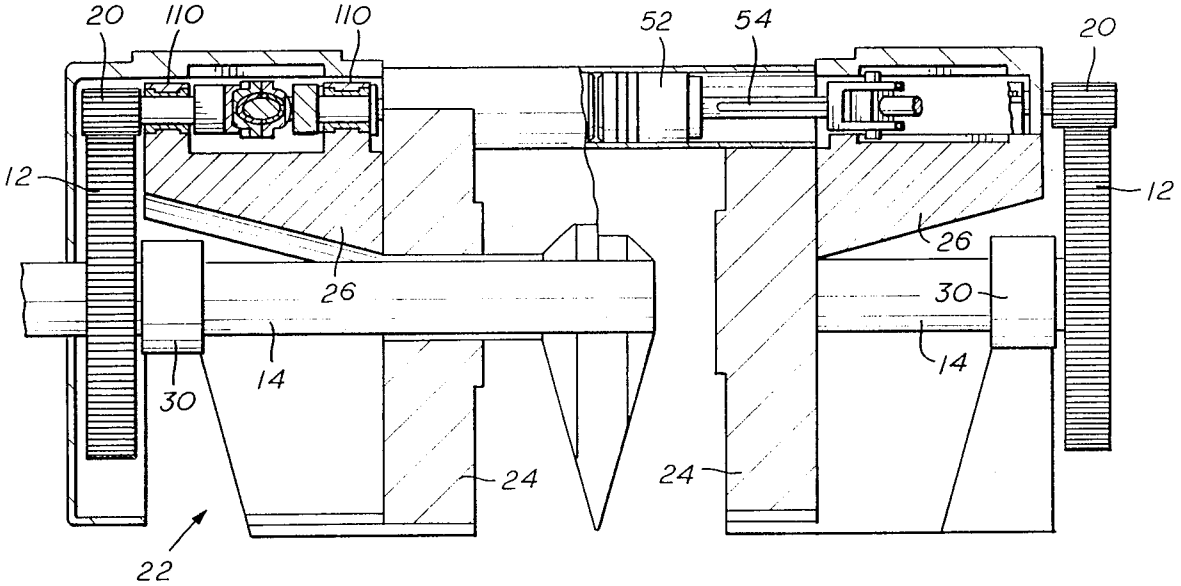
FIG. 5 is a section taken generally along line 5—5 of FIG. 4 and illustrating the base support for the engine and main drive shaft.
Figure 6:
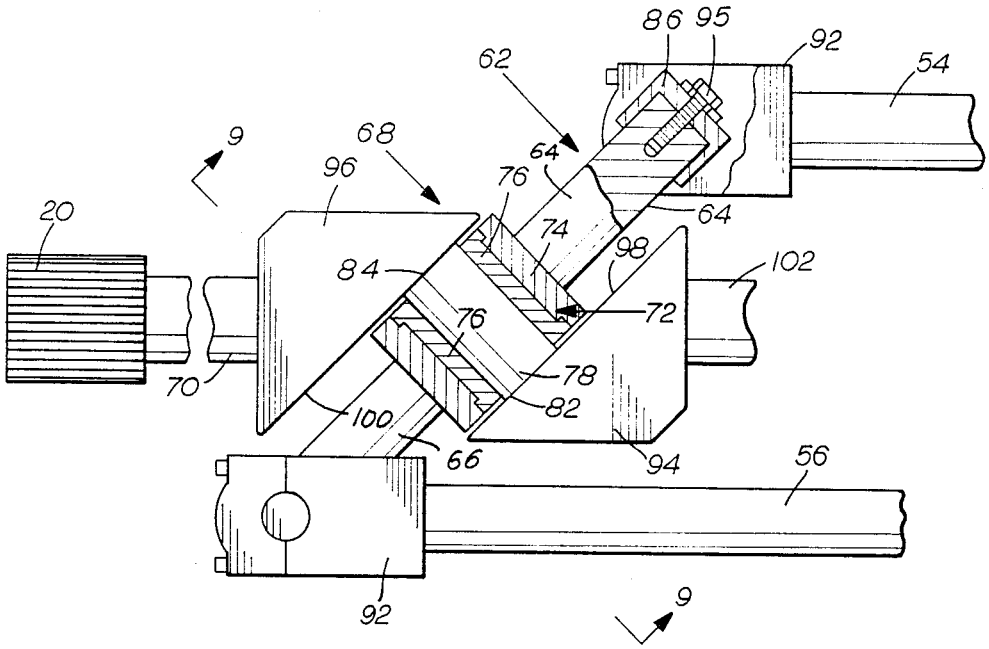
FIG. 6 is an enlarged top plan with certain parts broken away and shown in section of the Z-crank convertor associated with the rocker arm for connecting the rocker arm in drive relation to a pinion.
Figure 7:
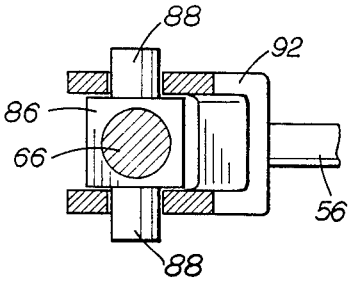
FIG. 7 is a section taken generally along line 7—7 of FIG. 6.
Figure 9:
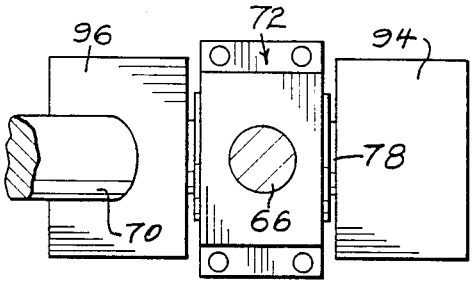
FIG. 9 is a section taken generally along line 9—9 of FIG. 6.
Figure 8:
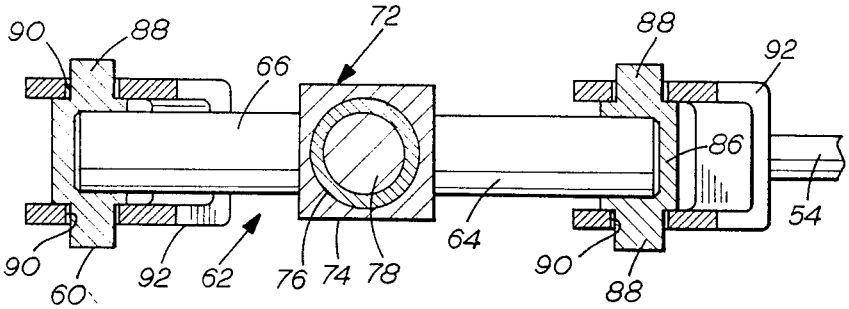
FIG. 8 is a section taken generally along line 8—8 of FIG. 6.
Figure 11:
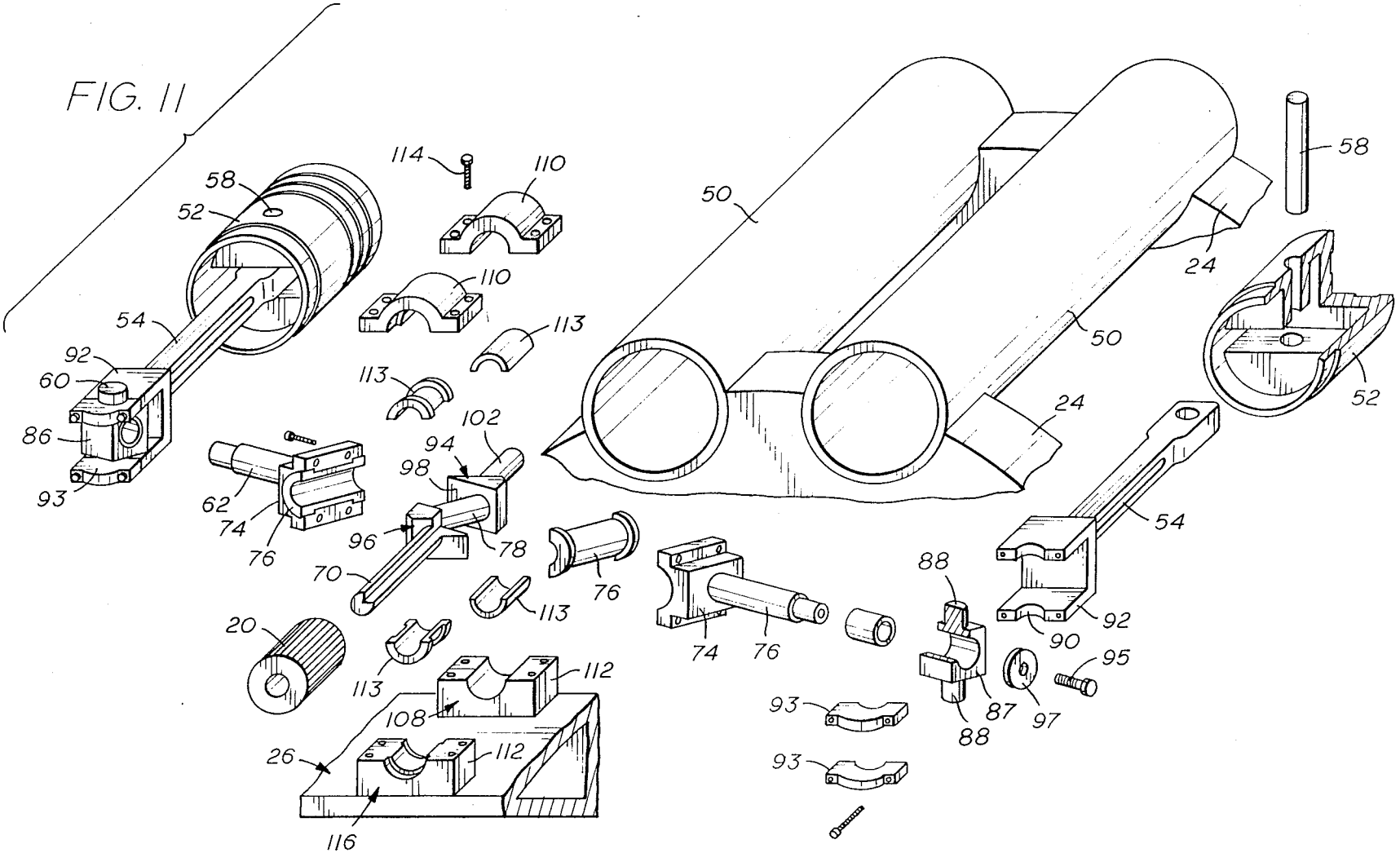
FIG. 11 is an exploded view of a power module illustrating the features of the power module permitting the separate removal and replacement of an individual power module.
Figure 12:
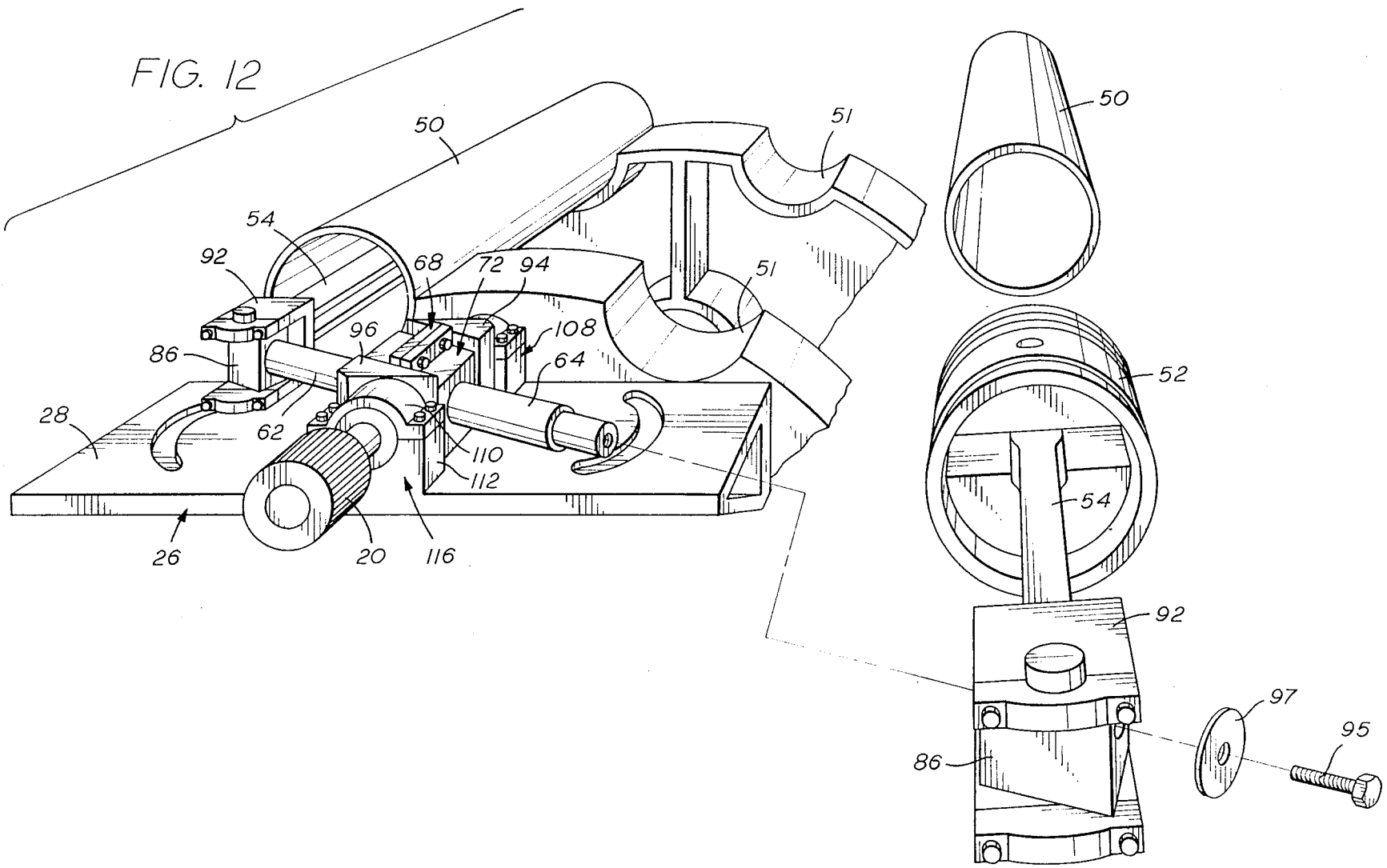
FIG. 12 is an exploded view showing the removal of a single piston and associated linkage.

Referring to FIGS. 4, 5 and 11 is noted that a back and forth oscillatory movement of rocker arm 62 is in a three (3) dimensional plane along an arcuate path indicated at 104 while supported on the upper surface of support plates 28. Follower shaft 102 is mounted within a bearing generally indicated 108 and formed of two (2) half sections defining a removable outer half section 110 and an inner half section 112 fixed to plate 26. Split bearing sleeves 113 are received within sections 110 and 112. Outer half section 110 is connected by suitable securing bolts 114 to inner half section 112. Power input shaft 70 is mounted in a similar bearing 116 which includes outer and inner half sections 110, 112 to permit removal of power input shaft 70. Thus, Z-crank convertor assembly 68 may be easily removed if desired. To remove and replace or repair a power module unit 18 including pistons 52, outer bearing halves 110 are first removed and then bearing block half sections 74 of bearing block 72 are unbolted to permit the withdrawal of rocker arm portions 64 and 66 from the respective bearing caps 86. Bearing caps 86 may be removed from clevises 92. Connecting rods 54 and 56 along with their associated pistons 52 may be removed from cylinders 50 for repair and/or replacement as desired. As shown in FIG. 12, a single piston 52 may be easily removed by removal of a screw 95 and associated plate 97 which connects bearing cap 86 to the associated rocker arm portion. Such a repair or replacement of a power module 18 does not affect any of the remaining power modules 18 and can be easily performed in a minimum of time.

Figure 13:
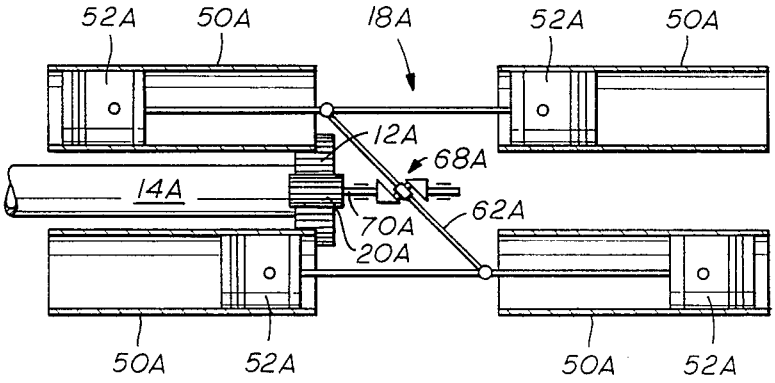
FIG. 13 is a schematic of a modified form of a power module in which only a single rocker arm and Z-crank convertor is utilized for driving an associated pinion and central gear.

Referring now to FIG. 13, a schematic view of a modified, power module 18A is illustrated in which a single rocker arm 62A is connected to pistons 52A. A Z-crank convertor shown at 68A is shown for rotating power input shaft 70A and pinion 20A secured thereto in driving engagement with main gear 12A secured to power output shaft 14A. Under certain conditions, it may be desirable to have piston 52A mounted in separate cylinders 50 and the modified arrangement shown in FIG. 13 provides such an arrangement. It is apparent that the functioning of cylinders 50A is similar to the functioning of cylinders 50.

Figure 14:
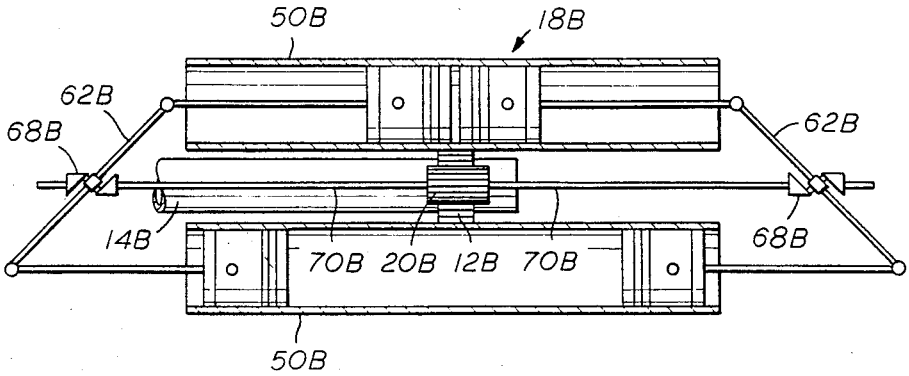
FIG. 14 is a schematic of a further modification of a power module in which a pair of rocker arms and Z-crank convertors are connected in drive relation to pinions for rotating a common central gear in drive relation.

Referring to FIG. 14, a further modification of a power module is shown illustrated at 18B in which rocker arms 62B are shown with Z-crank convertor 68B for rotating power input shafts 70B, both connected to a pinion gear 20B for rotating a main drive gear 12B connected to a drive shaft 14B. Such an arrangement permits pinion gear 20B and main gear 12B to be arranged centrally of the linkages for pistons 50B which may be desirable under certain space requirements. It is apparent that the present invention can be utilized for providing various arrangements of power modules in accordance with the invention, each power module being removable and comprising at least a pair of spaced cylinders having pistons mounted therein connected to opposite ends of a rocker arm for rotating a pinion shaft in driving relation to a main drive gear on a main drive shaft.

The utilization of a plurality of removable power modules arranged in circumferentially spaced relation about the outer periphery of a main drive gear secured in concentric relation to a main power output or drive shaft for driving the main drive shaft has many advantages in being removed and replaced without having any effect on the remaining power modules. A balanced engine is obtained with minimal resulting vibration and noise. Such removable power modules are obtained by the use of a pair of parallel cylinders with pistons therein connected to opposed ends of a rocker arm for rotating a power input shaft in driving relation through a Z-crank convertor member. Such an arrangement permits each power module to drive a separate power input shaft and as a result the plurality of power modules may have different timing cycles without affecting the driving relation of the remaining power modules. Each of the Z-crank convertors is in a driving relation to the periphery of a main drive gear secured to the main drive shaft. A balanced driving relation is provided by the arrangement of the plurality of drive modules symmetrically about the drive shaft in concentric relation thereto with the movement of the pistons being parallel to the longitudinal axis of the drive shaft.

One of the difficulties of internal or external combustion engines at low speeds is in forming a hydrodynamic oil film that prevents metal-to-metal contact in the bearings. The absence of such a hydrodynamic oil film results in undue wearing of the bearings and shafts and it is desirable to provide normal lubrication at all engine speeds and loads. The present invention by utilizing a Z-crank convertor mechanism and associated power input shaft for the main drive gear permits the Z-crank convertor bearings to form a hydrodynamic oil film and good lubrication at all engine speeds and loads.

Other advantages resulting from such an engine having power modules about a central main drive gear include (1) elimination of reduction gears since the engine itself reduces the speed to depending on the pinion to main drive gear ratio; (2) elimination of thrust forces since reaction forces are eliminated by a pair of main drive gears having opposed thread designs; (3) simplification of engine design and construction; and (4) simplification of maintenance, repair, and replacement of spare parts.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. In a reciprocating piston engine for rotating a main drive gear having a drive shaft connected thereto in concentric relation for rotation about a common longitudinal axis;

a plurality of power modules arranged in a circumferentially spaced relation about the outer periphery of said main drive gear with each of said power modules being arranged within a predetermined equal segment of said outer periphery; each power module comprising:

a pair of spaced parallel cylinders each having a piston mounted therein for reciprocal movement in opposite directions;

a piston rod connected to each piston;

a rocker arm connected to the piston rods for back and forth oscillating movement; and a linkage connected to said rocker arm for converting the movement of said rocker arm to a rotational movement, said linkage including a separate power input shaft rotated thereby about a fixed rotational axis and a gear operatively connected thereto in engagement with the outer periphery of said main drive gear for rotating said main drive gear and said drive shaft.

2. In a reciprocating piston engine for rotating a main drive gear having a drive shaft connected thereto in concentric relation for rotation about a common longitudinal axis;

a plurality of contiguous power modules arranged in a circumferentially spaced relation about the outer periphery of said main drive gear with each of said power modules being arranged within a predetermined equal segment of said outer periphery; each power module comprising;

a pair of spaced parallel cylinders each having a piston mounted therein for reciprocal movement in opposite directions;

a piston rod pivotally connected at one end to each piston;

a rocker arm pivotally connected for back and forth movement adjacent the other ends of said piston rods;

a Z-crank convertor connected to said rocker arm for converting the back and forth movement of said rocker arm to a rotational movement and including a separate power input shaft rotated thereby about a fixed longitudinal axis; and means operatively connected between said power input shaft and said main drive gear for rotating said main drive gear and said drive shaft upon oscillatory movement of said rocker arm.

3. A reciprocating piston engine comprising:

a main drive shaft having a longitudinal axis of rotation;

a main drive gear connected in concentric relation to said main drive shaft for driving said main drive shaft and having an outer peripheral surface adapted to be engaged in driving relation at a plurality of equally spaced predetermined locations about said outer peripheral surface;

a separate removable power module at each of said equally spaced predetermined locations, each power module including:

a pair of spaced parallel cylinders each having a piston mounted therein for reciprocal movement in opposite directions;

a piston rod connected to each piston;

a rocker arm connected to the piston rods for back and forth oscillating movement; and a linkage connected to said rocker arm for converting the movement of said rocker arm to a rotational movement, said linkage including a power input shaft driven thereby and a gear operatively connected to said power input shaft in engagement with the outer periphery of said main drive gear for rotating said main drive gear and said drive shaft.

4. A reciprocating piston engine comprising:

a main drive shaft having a longitudinal axis of rotation;

a main drive gear connected in concentric relation to said main drive shaft for driving said main drive shaft and having an outer peripheral surface adapted to be engaged in driving relation at a plurality of equally spaced predetermined locations about said outer peripheral surface;

a separate removable power module at each of said equally spaced predetermined locations each power module including:

a pair of spaced parallel cylinders each having a pair of opposed pistons mounted therein for reciprocal movement in opposite directions;

a piston rod connected to each piston;

a rocker arm pivotally connected for back and forth movement adjacent the other ends of said piston rods;

a Z-crank convertor connected to said rocker arm for converting the back and forth movement of said rocker arm to a rotational movement and including a power input shaft rotated thereby; and means operatively connected between said power input shaft and said main drive gear for rotating said main drive gear and said drive shaft upon oscillatory movement of said rocker arm.

5. In a reciprocating piston engine for rotating a main drive gear having a main drive shaft connected thereto in concentric relation for rotation about a common longitudinal axis;

a plurality of power modules arranged in a circumferentially spaced relation about the outer periphery of said main drive gear with each of said power modules being arranged within a predetermined equal segment of said outer periphery; each power module comprising:

a pair of spaced parallel cylinders, a piston mounted for reciprocation within each cylinder, a connecting rod pivotally connected at one end to each piston, a rocker arm extending between the connecting rods and said pair of pistons and being pivotally connected to the other end of said connecting rods;

a Z-crank convertor between the rocker arm and the drive shaft including a bearing block connected to said rocker arm and having a pair of opposed Z-crank convertor members on opposite sides of said bearing block each Z-crank convertor member having an inclined bearing face on one side thereof and an integral shaft on the other side thereof, the opposed bearing faces of said Z-crank convertor members being in bearing contact with said opposed bearing faces on said bearing block whereby upon back and forth movement of said rocker arm said bearing block rotates said Z-crank convertor members for rotation of the integral shafts thereon about a fixed rotational axis; and means connecting the shaft of at least one Z-crank convertor member to said main drive shaft for providing a power input shaft for rotation of said drive shaft.

6. A reciprocating piston engine comprising:

a main drive shaft having a longitudinal axis of rotation;

a main drive gear connected in concentric relation to said main drive shaft for driving said main drive shaft and having an outer peripheral surface adapted to be engaged in driving relation at a plurality of equally spaced predetermined locations about said outer peripheral surface;

separate support means adjacent each of said equally spaced predetermined locations, each support means including at least one plate member extending in a plane parallel to the rotational axis of said main drive shaft;

a separate power module removably mounted on each of said support means, each power module having a pair of spaced parallel cylinders each having a piston mounted therein for reciprocal movement;

a piston rod connected to each piston;

a rocker arm supported on said plate member and connected to the piston rods for back and forth movement; and a linkage connected to said rocker arm for converting the movement of said rocker arm to a rotational movement, said linkage including a power input shaft and a gear operatively connected thereto in engagement with the outer periphery of said main drive gear at one of said predetermined locations for rotating said main drive gear and said drive shaft.

7. A reciprocating piston engine for rotating a main drive shaft comprising:

a main drive gear secured to said drive shaft in concentric relation thereto;

a plurality of separate power modules arranged in a circumferentially spaced annular path about the longitudinal axis of the drive shaft and in concentric relation to said longitudinal axis;

each of said power modules having a pair of spaced parallel cylinders, each cylinder having a pair of opposed pistons therein mounted for reciprocal movement in opposite directions; and connecting power transfer means for each power module extending between the pistons and said drive shaft for converting the reciprocating motion of the pistons to rotational movement, said connecting power transfer means including a power input shaft in driving relation to said main drive gear for driving said main drive shaft.

8. A reciprocating piston engine for rotating a main drive shaft comprising:

a plurality of separate power modules arranged in a circumferentially spaced annular path about the longitudinal axis of the drive shaft and in concentric relation to said longitudinal axis;

each of said power modules having a pair of spaced parallel cylinders, each cylinder having a piston mounted therein for reciprocal movement;

linkages extending between the pistons and said drive shaft for converting the reciprocating motion of the pistons in driving relation to rotational movement of the main drive shaft;

each linkage including a rocker arm positioned adjacent said pair of spaced parallel cylinders, and connecting rods having one end pivotally connected to each of said pistons and an opposite end pivotally connected to an adjacent end of the rocker arm for moving the rocker arm upon the power stroke of the associated piston; and means permitting the removal of a separate power module relative to the remaining power modules without the removal of any portions of said remaining modules.

9. A power module for a reciprocating piston engine for rotating a main drive shaft and adapted to be positioned in a concentric relation to the longitudinal axis of the drive shaft; said power module comprising:

a pair of spaced parallel cylinders, a piston mounted for reciprocation within each cylinder, a connecting rod pivotally connected at one end to each piston, a rocker arm extending between the connecting rods for said pair of pistons and being pivotally connected to the other end of said connecting rods;

a Z-crank convertor between the rocker arm and the drive shaft, said Z-crank convertor including a bearing block connected to said rocker arm and having a pair of opposed smooth bearing faces, a pair of opposed Z-crank convertor members on opposite sides of said bearing block, each Z-crank convertor member having an inclined thrust bearing face on one side thereof and an integral shaft on the other side thereof, the opposed thrust bearing faces of said Z-crank convertor members being in thrust bearing contact with said opposed smooth bearing faces on said bearing block whereby upon back and forth movement of said rocker arm said bearing block rotates said Z-crank convertor members for rotation of the shafts thereon; and means connecting the integral shaft of at least one Z-crank convertor member to said drive shaft for rotation of said drive shaft, said connecting means including a pair of gears for transmitting the driving force to the drive shaft from said shaft of said one Z-crank convertor member.

10. A power module as set forth in claim 9 wherein each of said cylinders has a pair of opposed pistons mounted therein for reciprocation and a rocker arm is provided adjacent each end of the spaced cylinders; and a Z-crank convertor is provided between each rocker arm and the drive shaft.

11. A power module as set forth in claim 9 wherein said bearing block on said rocker arm includes a journal having opposed ends in bearing sliding contact with said opposed bearing faces on said Z-crank convertor members, said rocker arm being mounted for pivotal movement about said journal.

12. A power module as set forth in claim 9 wherein said rocker arm is mounted for rotative movement about its longitudinal axis relative to said connecting rods and for back and forth reciprocal movement in an arcuate path.

13. A power unit as set forth in claim 9 wherein a base supports said power module thereon, and bearings on said base receive said shafts of said Z-crank convertor members for rotation, said bearings each including an inner portion secured to said base and an outer portion removable from said base to permit removal of the associated shaft therefrom thereby to permit said power module to be easily removed from said base.

14. A power unit as set forth in claim 9 wherein a universal joint connects said rocker arm to said connecting rods thereby to permit rotational movement of said rocker arm about its longitudinal axis relative to said connecting rods.

15. A power unit as set forth in claim 14 wherein a removable pin connects each connecting rod to said rocker arm thereby to permit the associated piston to be easily removed from its associated cylinder.

16. A reciprocating piston engine for rotating a main drive shaft comprising:

a plurality of separate generally identical power modules arranged in a circumferentially spaced circular path about the longitudinal axis of the drive shaft and in concentric relation thereto, each of said power modules being positioned within a predetermined arcuate segment of said circular path;

each power module including a pair of spaced parallel cylinders, at least one piston mounted within each cylinder for reciprocation, a connecting rod pivotally connected to each piston, a rocker arm extending between the connecting rods and pivotally connected thereto, and a Z-crank convertor member operatively connected between the rocker arm and said drive shaft for converting the reciprocating motion of the pistons to the rotational movement of the drive shaft;

means mounting said rocker arm on said connecting rods for rotation bout its longitudinal axis relative to said connecting rods, said rocker arm moving back and forth in an arcuate swinging movement in a three dimensional plane for transmitting forces from said pistons;

a turbocharger receiving exhaust gases from the engine and compressing air for delivery to the engine; and means connected to said main drive shaft to drive said turbocharger at low engine speeds to supply air for the engine.

17. A reciprocating piston engine for rotating a main drive shaft comprising:

a plurality of separate power modules arranged in a circumferential spaced circular path about the longitudinal axis of the drive shaft and in concentric relation thereto;

each of said power modules being positioned within a predetermined arcuate segment of said circular path, each module including a piston and cylinder combination and a linkage extending between the piston and said drive shaft for transmitting the reciprocating motion of the pistons to the rotational motion of the shaft; and means mounting each power module on said engine permitting removal of a predetermined power module from the engine relative to the remaining power modules thereby to allow removal and replacement of a selected individual power module.

18. A reciprocating piston engine as set forth in claim 17 wherein the predetermined arcuate segment of each of the power modules is identical and comprises at least fifteen degrees of the circular path.

19. A reciprocating piston engine as set forth in claim 18 wherein each power module includes a pair of spaced parallel cylinders, each cylinder having a pair of opposed pistons mounted therein for reciprocation.

20. A reciprocating piston engine as set forth in claim 17 wherein said linkage comprises a Z-crank convertor.

21. A reciprocating piston engine for rotating a main drive shaft comprising:

at least three separate generally identical power modules arranged in a circumferentially spaced circular path about the longitudinal axis of the drive shaft and in concentric relation thereto, each of said power modules being positioned within a predetermined arcuate segment of said circular path;

each power module including a pair of spaced parallel cylinders, at least one piston mounted within each cylinder for reciprocation, a connecting rod pivotally connected to each piston, a rocker arm extending between the connecting rods and pivotally connected thereto, and a Z-crank convertor operatively connected between the rocker arm and said drive shaft for transmitting the reciprocating motion of the pistons to the rotational movement of the drive shaft; and means to permit independent removal of each of said power modules.

22. A reciprocating piston engine as set forth in claim 21 wherein each of said pairs of spaced cylinders has a pair of opposed pistons therein mounted for reciprocation, and a rocker arm is positioned adjacent each end of the cylinders pivotally connected to connecting rods from an adjacent pair of pistons.

23. A reciprocating piston engine as set forth in claim 21 wherein said Z-crank convertor comprises a bearing block on said rocker arm centrally of its length and having a pair of opposed smooth bearing surfaces, and a pair of Z-crank convertor members on opposite sides of said bearing block, each convertor member having an inclined bearing face in bearing contact with an associated bearing surface on said bearing block whereby upon back and forth movement of said rocker arm said bearing block rotates said Z-crank convertor members; and means operatively connected between said Z-crank convertor members and said drive shaft for rotating said drive shaft.

24. In a reciprocating piston engine for rotating a main drive gear secured in concentric relation to a hollow main drive shaft extending through the engine and mounted for rotation about a common longitudinal axis with the hollow drive shaft;

a plurality of power modules arranged in a circumferentially spaced relation about the outer periphery of said main drive gear with each of said power modules being arranged within a predetermined equal segment of said outer periphery;

each power module including a pair of cylinders each having a piston mounted therein for reciprocal movement, a piston rod connected to each piston, and a linkage connected to the piston rods, said linkage including a separate power input shaft rotated thereby about a fixed rotational axis and a gear operatively connected to the power input shaft in engagement with said main drive gear for rotating said main drive gear and said drive shaft;

a propeller shaft connected to said hollow drive shaft for rotation about said common longitudinal axis, and means mounted within said hollow drive shaft of the engine to allow pitch control devices for an associated propeller to pass through said hollow main drive shaft of the engine.

25. A reciprocating piston engine for rotating a main drive shaft comprising:

a plurality of separate generally identical power modules arranged in a circumferentially spaced circular path about the longitudinal axis of the drive shaft and in concentric relation thereto, each of said power modules being positioned within a predetermined arcuate segment of said circular path;

each power module including a pair of spaced parallel cylinders, at least one piston mounted within each cylinder for reciprocation, a connecting rod pivotally connected to each piston, a rocker arm extending between the connecting rods and pivotally connected thereto, said rocker arm having a pair of opposed bearing surfaces thereon intermediate its length;

a pair of opposed Z-crank convertor members in bearing contact with said bearing surfaces for effecting rotation of said drive shaft upon back and forth arcuate movement of said rocker arm, said opposed Z-crank convertor members each including an inclined bearing surface on one side thereof and a shaft extending from the other side thereof; and fixed bearing means for each of the shafts on said Z-crank convertor members, the shaft for one of said Z-crank convertor members being mounted for free rotation and the shaft for the other Z-crank convertor member being a power input shaft operatively connected in drive relation to said drive shaft for rotating said drive shaft.

26. A reciprocating piston engine as set forth in claim 25 wherein a pair of gears are provided between the power input shaft of said other Z-crank convertor member and said drive shaft for rotation of said drive shaft.

27. A reciprocating piston engine as set forth in claim 25 wherein each of said pair of spaced cylinders has a pair of opposed pistons therein mounted for reciprocation, and a rocker arm is positioned adjacent each end of the cylinders pivotally connected at its ends to connecting rods from an adjacent pair of pistons.

28. A reciprocating piston engine as set forth in claim 25 wherein means mount said rocker arm on said connecting rods for rotation about its longitudinal axis relative to said connecting rods.

29. A reciprocating piston engine for rotating a main drive shaft comprising:

a plurality of separate generally identical power modules arranged in circumferentially spaced circular path about the longitudinal axis of the drive shaft and in concentric relation thereto, each of said power modules being positioned within a predetermined arcuate segment of said circular path;

each power module including a pair of spaced parallel cylinders, at least one piston mounted within each cylinder for reciprocation, a connecting rod pivotally connected to each piston, a rocker arm extending between the connecting rods and pivotally connected thereto, said rocker arm having a pair of opposed bearing surfaces thereon intermediate its length;

a pair of opposed Z-crank convertor members in bearing contact with said bearing surfaces for effecting rotation of said drive shaft upon back and forth arcuate movement of said rocker arm;

means mounting said rocker arm on said connecting rods for rotation about its longitudinal axis relative to said connecting rods, said rocker arm moving back and forth in an arcuate swing movement in a three dimensional plane for transmitting forces from said pistons;

each of said Z-crank convertor members having on one side an inclined bearing plate forming the bearing surface and on the other side a shaft; and fixed bearing means for each of the shafts on said Z-crank convertor means, the shaft of one of said Z-crank convertor members being a power input shaft operatively connected to said drive shaft for effecting rotation of said drive shaft.

30. A reciprocating piston engine as set forth in claim 29 wherein the shaft for one of the Z-crank convertor members is mounted for free rotation within its bearing means and the shaft for the other Z-crank convertor member is a power input shaft mounted in driving relation within its bearing means for rotating said drive shaft.

31. A reciprocating piston engine as set forth in claim 30 wherein a pair of meshing gears are positioned between the power input shaft of said other Z-crank convertor member and said drive shaft for rotation of said drive shaft.

32. A reciprocating piston engine as set forth in claim 30 wherein the shafts for the Z-crank converter members are in spaced axial alignment with each other, and said bearing means for said shafts are removably mounted to permit said shafts to be easily removed.

33. A reciprocating piston engine as set forth in claim 30 wherein a base supports each of said power modules thereon and said bearing means are mounted on said base thereby to permit removal of said power module from said base upon removal of said bearing means.

* * * * *